US006960105B2

(12) United States Patent
Uraki et al.

(10) Patent No.: US 6,960,105 B2
(45) Date of Patent: Nov. 1, 2005

(54) JET PROPULSION BOAT

(75) Inventors: Mamoru Uraki, Saitama (JP); Yoshiaki Hirakata, Saitama (JP); Takao Kochi, Saitama (JP); Hajime Shogase, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/245,286

(22) Filed: Sep. 18, 2002

(65) Prior Publication Data

US 2003/0082965 A1 May 1, 2003

(30) Foreign Application Priority Data

Sep. 18, 2001 (JP) ..... 2001-284181
Sep. 18, 2001 (JP) ..... 2001-284182

(51) Int. Cl.[7] ..... B63H 21/21
(52) U.S. Cl. ..... 440/1; 440/87
(58) Field of Search ..... 123/319, 320, 123/325, 329, 333, 335, 361; 114/144 R, 151, 144 RE; 440/1, 2, 38, 40–42, 84, 87

(56) References Cited

U.S. PATENT DOCUMENTS 6,119,653 A * 9/2000 Morikami ..... 123/339.23
6,124,809 A * 9/2000 Boudriau ..... 340/984
6,159,059 A 12/2000 Bernier et al.
6,336,833 B1 * 1/2002 Rheault et al. ..... 440/1
6,390,862 B1 * 5/2002 Eichinger ..... 440/1

(Continued)

FOREIGN PATENT DOCUMENTS

JP 2001354195 A * 12/2001 ..... B63H/25/46

OTHER PUBLICATIONS

Translation of application No. JP 2001–284181, now patent No. JP2003–090234 A.*

Translation of application No. JP 2001–284182, now patent No. JP2003–089387 A.*

*Primary Examiner*—S. Joseph Morano
*Assistant Examiner*—Ajay Vasudeva
(74) *Attorney, Agent, or Firm*—Birch Stewart Kolasch & Birch LLP

(57) ABSTRACT

A control unit is provided for increasing the number of engine revolutions per minute to a predetermined number of revolutions per minute when the throttle is closed and when the engine has been rotated for more than a prescribed time period at more than a prescribed number of revolutions per minute, and the throttle has been opened for more than a prescribed time period at more than a prescribed opening. The control unit increases the number of engine revolutions per minute to a predetermined number of revolutions per minute irrespective of the throttle and maintains the same for a predetermined retention time when the steering handle is turned to the left or the right by more than a prescribed angle. The time to start controlling the number of engine revolutions per minute may be delayed by providing a delay time for delaying the time to start controlling the engine revolutions. The number of engine revolutions per minute may be controlled after the hull is underwater. As a consequence, the amount of sideslip of the jet propulsion boat can be improved. In addition, since the control unit for increasing the number of engine revolutions per minute to a predetermined number of revolutions per minute irrespective of the throttle and maintaining the same for a predetermined retention time is provided, the quantity of jet water stream is secured. As a result, the steering of the jet propulsion boat is improved.

8 Claims, 14 Drawing Sheets

U.S. PATENT DOCUMENTS 6,428,371 B1 * 8/2002 Michel et al. ..... 440/38
6,478,638 B2 * 11/2002 Matsuda et al. ..... 440/1
6,508,680 B2 * 1/2003 Kanno ..... 440/1
6,551,152 B2 * 4/2003 Matsuda et al. ..... 440/1
6,568,968 B2 * 5/2003 Matsuda ..... 440/87
6,589,085 B2 * 7/2003 Matsuda et al. ..... 440/1
6,709,302 B2 * 3/2004 Yanagihara ..... 440/1
6,709,303 B2 * 3/2004 Umemoto et al. ..... 440/1
6,733,350 B2 * 5/2004 Iida et al. ..... 440/84
6,783,408 B2 * 8/2004 Uraki et al. ..... 440/1
6,855,014 B2 * 2/2005 Kinoshita et al. ..... 440/1
2001/0036777 A1 * 11/2001 Iida et al. ..... 440/84
2003/0000443 A1 * 1/2003 Bernier et al. ..... 114/151
2003/0013354 A1 * 1/2003 Yanagihara ..... 440/1
2003/0145826 A1 * 8/2003 Umemoto et al. ..... 123/350

* cited by examiner 70
71
76
77
mph
0
1
2
3
4
5
6
7
8

JET PROPULSION BOAT

CROSS-REFERENCE TO RELATED APPLICATIONS

This nonprovisional application claims priority under 35 U.S.C. § 119(*a*) on Patent Application Nos. 2001-284181 and 2001-284182, filed in Japan on Sep. 18, 2001. The entirety of each of the above applications is hereby incorporated by reference.

BACKGROUND OF THE INVENTION

1. Field of the Invention

The present invention relates to a jet propulsion boat of the type in which the hull is advanced by discharging a jet water stream through a nozzle and the hull is turned around to the left or to the right by changing the direction of the nozzle by a steering handle.

2. Description of Background Art

The jet propulsion boat obtains its propulsion force by discharging a jet water stream and changes the direction of the hull by changing the direction of the jet water stream. Therefore, it cannot turn around without the jet water stream.

As a general action of a human, for example, when evading an obstacle, he/she tends to reduce the speed of the boat and operate the steering handle to the left or the right. Reducing the vessel speed means to close the throttle. Even when turning the steering handle to the left or the right with the throttle closed, it cannot obtain a sufficient jet water stream because the number of revolution of the engine is low. Consequently, he/she cannot turn the hull around at will. This is especially obvious when the speed of the hull is high.

As a technology for compensating such characteristics of jet propulsion boats, U.S. Pat. No. 6,159,059, for example, is known.

The aforementioned technology is, according to FIG. 2 and FIG. 3 in the publication of the same patent, constructed in such a manner that one end of the throttle cable 44 is connected to the throttle regulator 46 and the other end of the throttle cable 44 is connected to the throttle lever 34. A throttle return spring 49 is disposed for restoring the throttle lever 34. A compressive material 52 is disposed at the foot of the throttle lever 34, so that the throttle regulator 46 is prevented from closing suddenly when the throttle lever 34 is released. A prescribed jet water stream is maintained for a certain period of time even after the throttle lever 34 is returned.

However, after "a certain period of time" for maintaining a prescribed jet water stream has passed, the quantity of water is reduced and thus the turnability is lowered. This lowers usability. In addition, when the speed of the hull is low, it is not necessary to maintain a jet water stream.

SUMMARY OF THE INVENTION

Accordingly, it is an object of the present invention to provide a jet propulsion boat in which good turnability is maintained during low speed travel if certain conditions are met.

In order to achieve the aforementioned object, according to a first aspect of the present invention, a jet propulsion boat is ofthe type in which the hull is advanced by generating a jet water stream by a jet propulsion unit driven by an engine and discharging the jet water stream through the nozzle, and the hull is turned around to the left and the right by changing the direction of the nozzle by the steering handle. The jet propulsion boat includes a control unit for controlling the number of revolutions per minute when the throttle is closed and when the engine has been rotated at more than a prescribed number of revolutions per minute and that a throttle has been opened at more than a prescribed opening. The control unit increases the number of engine revolutions per minute to a predetermined number of revolutions per minute irrespective of the throttle and maintains the same number of revolutions per minute for a predetermined retention time when the steering handle is turned to the left or the right by more than a prescribed angle, wherein a delay time for delaying a time to start controlling the number of engine revolutions per minute is provided in the control unit.

In order to achieve the aforementioned object, according to a second aspect of the present invention, a jet propulsion boat is ofthe type in which the hull is advanced by generating a jet water stream by a jet propulsion unit driven by an engine and discharging the jet water stream through the nozzle, and the hull is turned around to the left and the right by changing the direction of the nozzle by the steering handle. The jet propulsion boat includes a control unit for increasing the number of engine revolutions per minute to a predetermined number of revolutions per minute when the throttle is closed and when the engine has been rotated for more than a prescribed time period at more than a prescribed number of revolutions per minute, and a throttle has been opened for more than a prescribed time period at more than a prescribed opening. The control unit increases the number of engine revolutions per minute to a predetermined number of revolutions per minute irrespective of the throttle and maintains the same number of revolutions per minute for a predetermined retention time when the steering handle is turned to the left or the right by more than a prescribed angle.

When the throttle is closed and the steering handle is turned in order to evade an obstacle which has appeared in front of the hull, the quantity of the jet water stream is reduced and thus turnability is lowered. Therefore, the number of engine revolutions per minute is increased to the predetermined number of revolutions per minute under certain conditions to increase the quantity of the jet water stream.

When the throttle is closed and the number of engine revolutions per minute is lowered to travel at a low speed for example for entering into a port, it is not necessary to increase the number of engine revolutions per minute. Since the turnability is put in question in this case, it is not necessary to increase the number of engine revolutions per minute when the steering handle is not turned.

Therefore, the precondition is determined to be such that when the throttle is closed under the conditions that the engine has been rotated at more than a prescribed number of revolutions per minute and the throttle has been opened at more than a prescribed opening, and that the steering handle is turned to the left or to the right by more than a prescribed angle.

In addition, the precondition is determined to be such that when the throttle is closed under the conditions that the engine has been rotated for more than a prescribed time period at more than a prescribed number of revolutions per minute and the throttle has been opened for more than a prescribed time period at more than a prescribed opening, and that the steering handle is turned to the left or to the right by more than a prescribed angle.

Accordingly, the number of engine revolutions per minute is increased to a predetermined number of revolutions per minute only when necessary. In other words, the quantity of the jet water stream is secured by providing a control unit for increasing the number of engine revolutions per minute to a predetermined number of revolutions per minute and maintaining the same number of revolutions per minute for a predetermined retention time. Consequently, the steering of a jet propulsion boat is improved.

It is well known that the amount of sideslip of the hull is large when the steering handle is turned while cruising at a high speed, while the amount of sideslip of the hull is small when the steering handle is turned while cruising at a low speed. Therefore, the time to start controlling of the number of engine revolutions per minute is delayed by providing delay time for delaying the time to start controlling of the engine revolutions.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
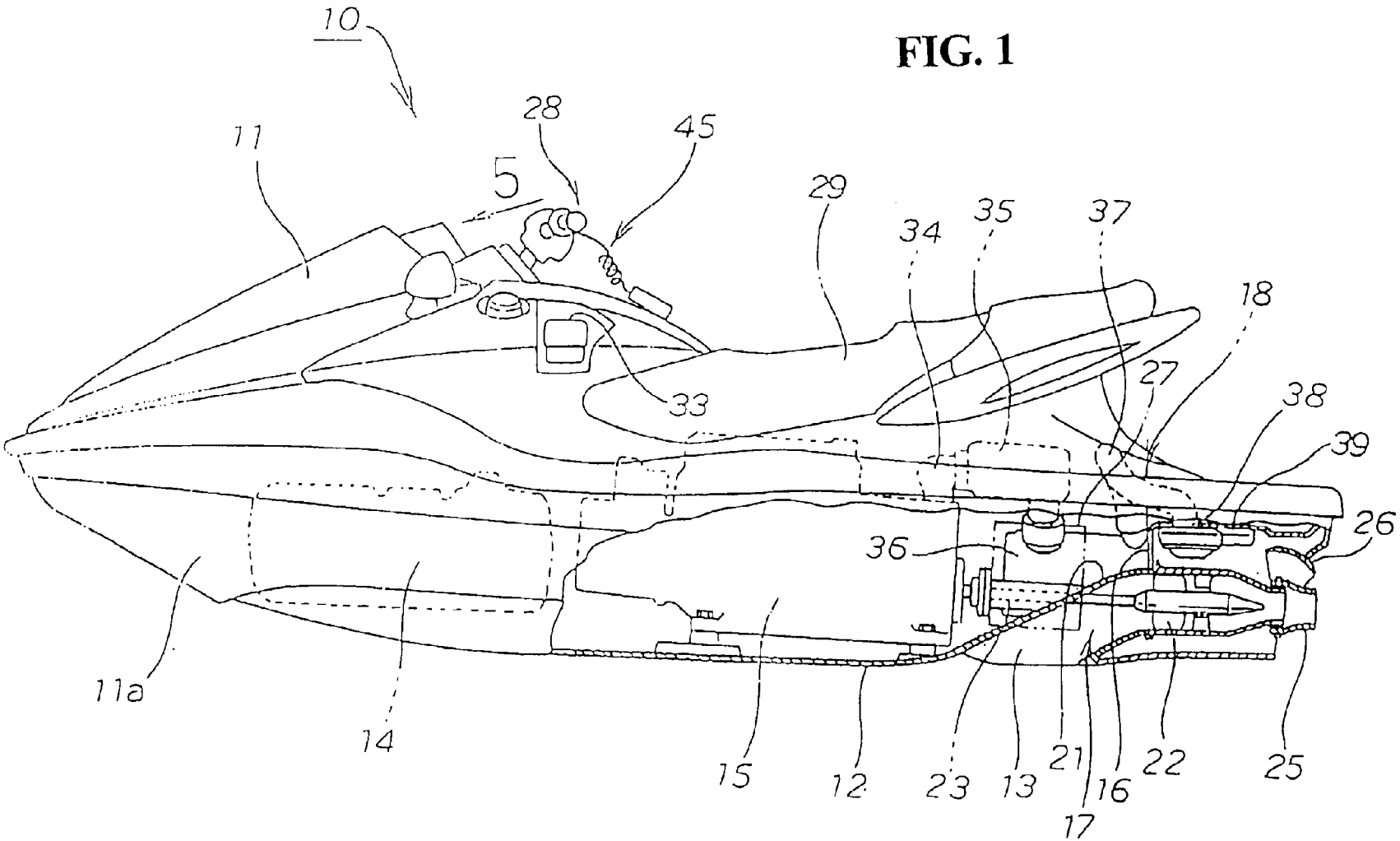
FIG. 1 is a side view of a jet propulsion boat according to the present invention.

Referring now to the attached drawings, an embodiment of the present invention will be described below. The drawings should be viewed in the direction of orientation of the reference numerals.

FIG. 1 is a side view of a jet propulsion boat according to the present invention. The jet propulsion boat 10 according to the present invention includes a fuel tank 14 mounted at the front portion 11*a* of the hull 11. An engine 15 is provided rearwardly of the fuel tank 14. A pump chamber 16 is provided rearwardly of the engine 15. A jet propulsion unit 17 is provided in the pump chamber 16. An exhaust unit 18 is attached to the engine 15 on the air intake side and to the pump chamber 16 on the exhaust side. A steering handle 28 is disposed above the fuel tank 14. A seat 29 is mounted rearwardly of the steering handle 28.

The jet propulsion unit 17 is constructed in such a manner that a housing 21 extending rearward from the opening 13 of the vessel bottom 12 is provided. An impeller 22 is rotatably mounted in the housing 21. The impeller 22 is connected to the drive shaft 23 of the engine 15.

In the jet propulsion unit 17, water sucked from the opening 13 of the vessel bottom 12 is splashed or sprayed rearwardly of the hull 11 from the steering pipe 25, which acts as a nozzle, through the rear end opening of the housing 21 by driving the engine 15 and rotating the impeller 22.

The steering pipe 25 is a member mounted at the rear end of the housing 21 so as to be capable of a swinging motion in the lateral direction. The steering pipe 25 is a steering nozzle for controlling the steering direction of the hull 11 by operating the steering handle 28 so as to swing in the lateral direction.

The jet propulsion boat 10 can be propelled by supplying fuel from the fuel tank 14 to the engine 15 to drive the engine 15, transmitting a driving force of the engine 15 to the impeller 22 via the drive shaft 23, sucking water from the opening 13 of the vessel bottom 12 by rotating the impeller 22, and splashing sucked water through the rear end of the housing 21 from the steering pipe 25.

As is described later, the jet propulsion boat 10 is a vessel provided with a control unit for controlling the quantity of a jet water stream or the time during which the jet water stream can be splashed with a high degree of accuracy. It is also a vessel which is capable of switching the mode to a limited operation mode in which the output of the engine is limited so as not to exceed a prescribed output.

In FIG. 1, reference numeral 26 designates a reverse bucket for covering the steering pipe 25 when moving the vessel backward to flow a jet water stream obliquely downward toward the front. Reference numeral 33 designates an operation knob for operating the reverse bucket 26. Reference numeral 34 designates an exhaust pipe. Reference numeral 35 designates an exhaust body. Reference numeral 27 designates a battery, which is a power source, mounted on the hull 11. Reference numeral 36 designates a water muffler. Reference numeral 37 designates a water lock pipe. Reference numeral 38 designates a tail pipe. Reference numeral 39 designates a resonator. Reference numeral 45 designates a main switch with a lanyard switch.

Figure 2:
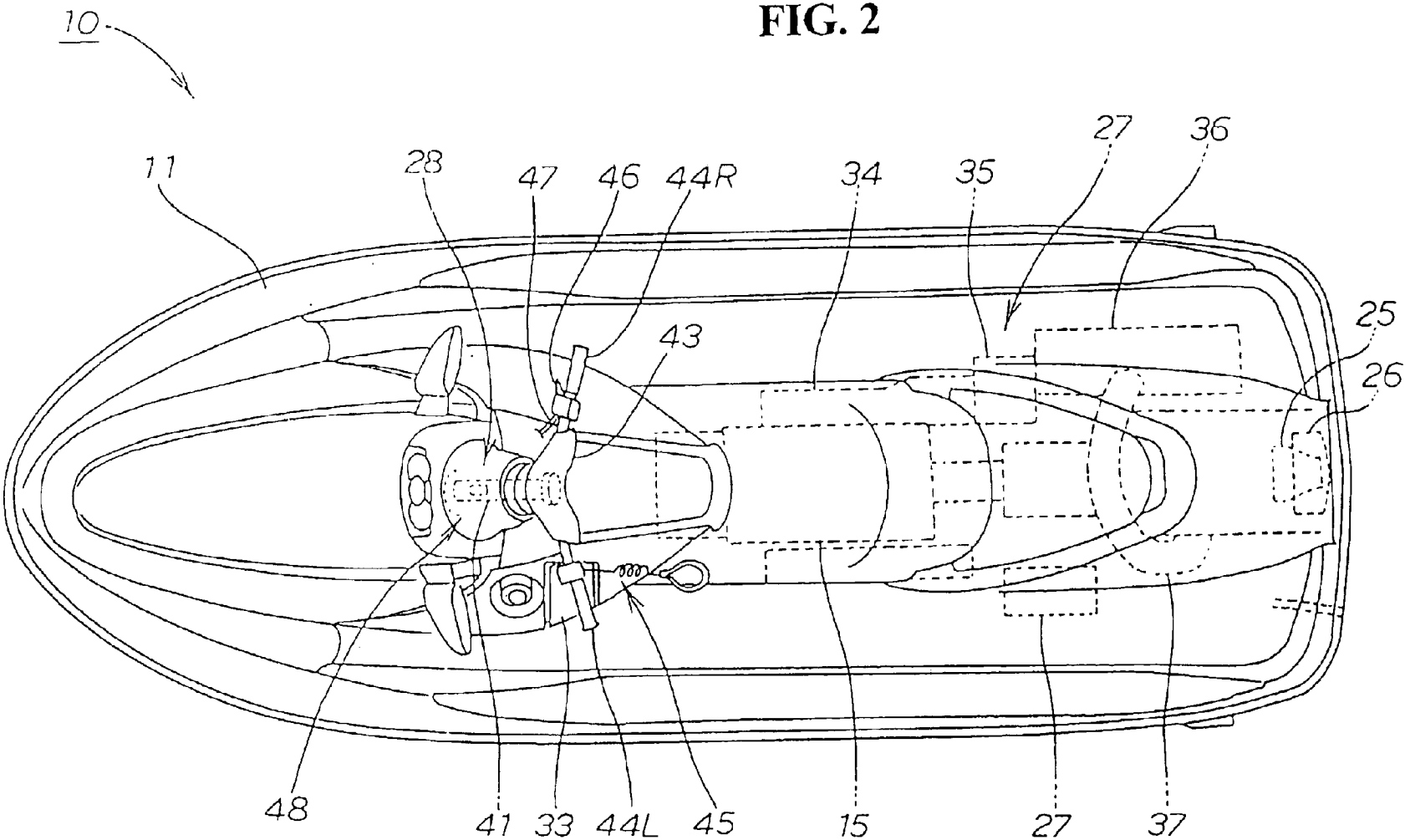
FIG. 2 is a plan view of the jet propulsion boat according to the present invention.

FIG. 2 is a plan view of the jet propulsion boat according to the present invention, in which the steering handle 28 includes a steering shaft 41 mounted rotatably on the hull. A handle bar 43 is mounted at the upper end of the steering shaft 41. Left and right handle grips 44L, 44R are attached on the left and the right ends of the handle bar 43. The main switch 45 with the lanyard switch is provided at the foot of the left handle grip 44L. A throttle lever 46 is provided at the foot of the right handle grip 44R for a swinging motion. A throttle cable 47 extends from the throttle lever 46 to the throttle. A turnaround detecting mechanism 48 is provided at the lower end of the steering shaft 41.

Figure 3:
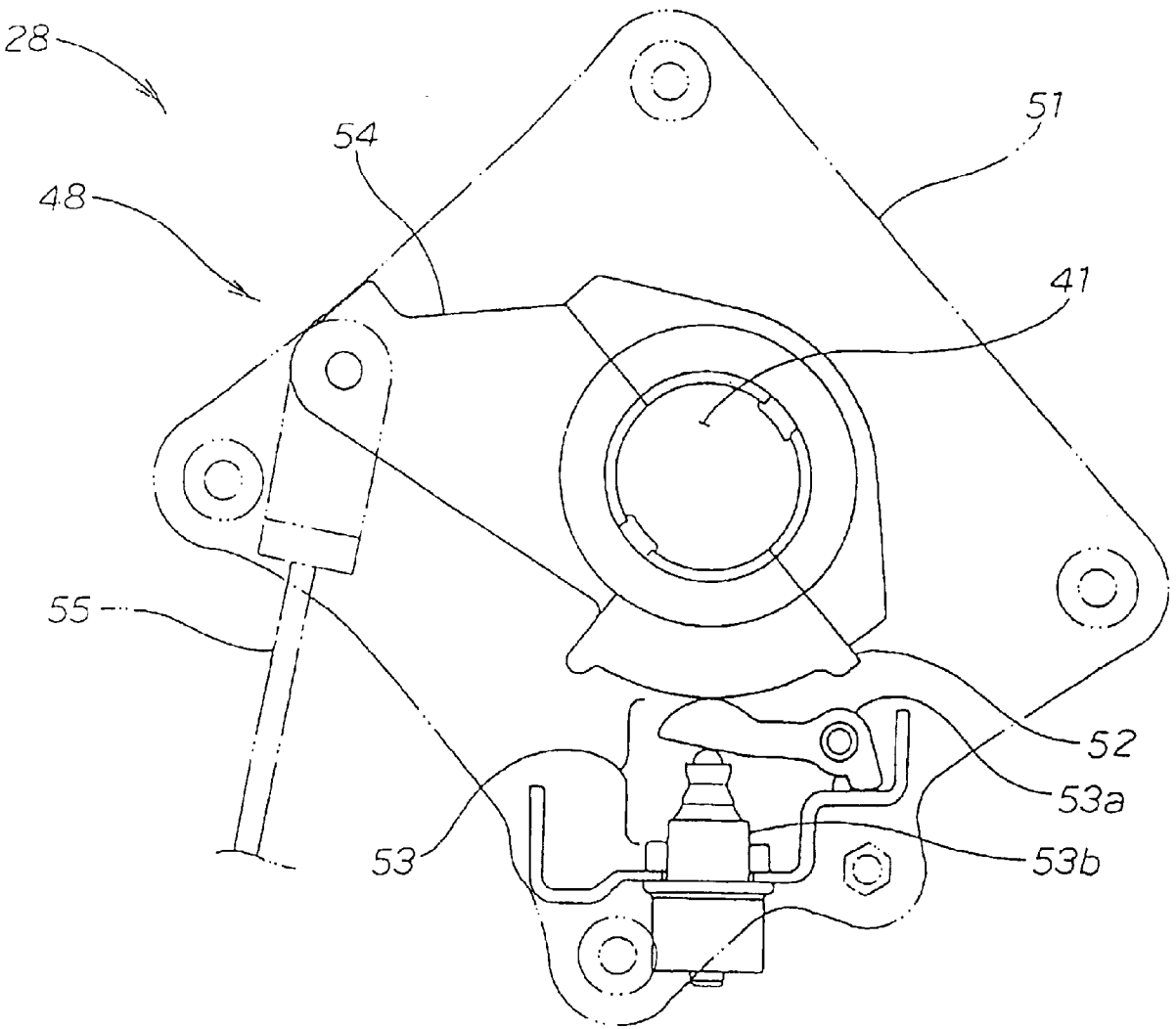
FIG. 3 is a plan view of a turnaround mechanism of a jet propulsion boat according to the present invention.

FIG. 3 is a plan view of a turnaround mechanism 48 of a jet propulsion boat according to the present invention, in which the turnaround detecting mechanism 48 includes a bracket 51 mounted on the hull 11 (See FIG. 1). A switch cam 52 is attached at the lower end of the steering shaft 41. A turnaround switch 53 is provided for turning ON and OFF by means of the switch cam 52. A cam plate 54 is attached at the lower end of the steering shaft 41. Reference numeral 55 designates a driving link for driving the steering pipe 25 (See FIG. 1) by being mounted rotatably at the end of the cam plate 54. Reference numeral and character 53*a* designates a switch lever of the turnaround switch 53. Reference numeral and character 53*b* designates a body portion of the turnaround switch 53.

Figure 4:
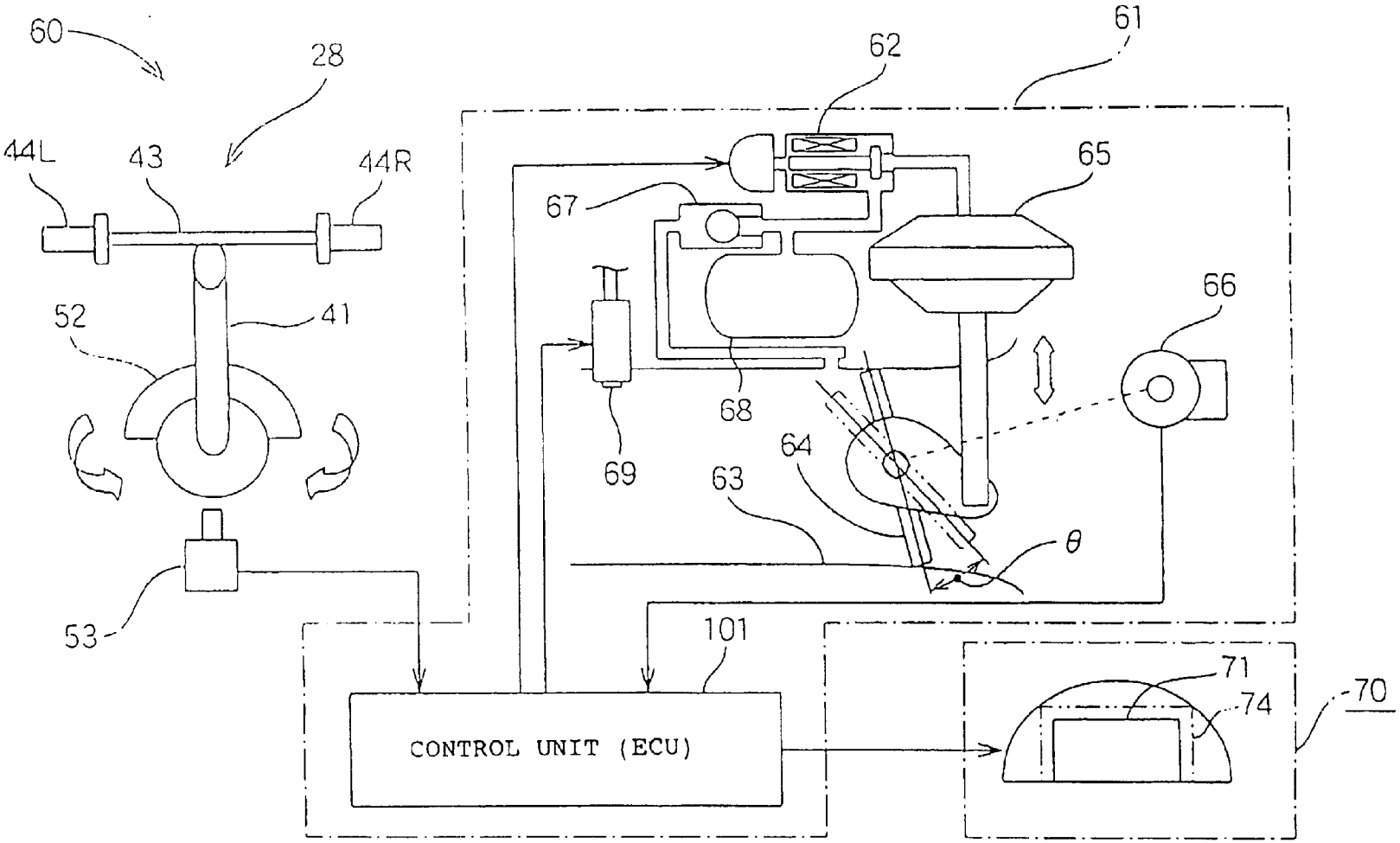
FIG. 4 is a block diagram of the OTS controlling unit in the jet propulsion boat according to the present invention.

FIG. 4 is a block diagram of the OTS controlling unit in the jet propulsion boat according to the present invention. OTS used here is an abbreviation of Off Throttle Steering System and is a unit for allowing a prescribed jet water stream to be maintained for a certain time period even when the throttle 34 is released.

The OTS controlling unit 60 in the jet propulsion boat is a system includes the steering handle 28 for steering the hull 11 (See FIG. 1). A fuel injection system 61 is provided for supplying fuel to the engine 15 (See FIG. 1). A control unit (ECU) 101 is provided for controlling the hull 11. A display unit 70 provided with a display controlling portion 74 serves as a control unit for displaying the condition of the hull 11. The OTS controlling unit 60 is a system for controlling the number of engine revolutions per minute to a predetermined number of revolutions per minute when the throttle 64 is closed and when the engine 15 has been rotated for more than a prescribed time period at more than a prescribed number of revolutions per minute, and the throttle 64 has been opening for more than a prescribed time period at more than a prescribed opening. The OTS controlling unit 60 increases the number of revolutions per minute of the engine 15 to a predetermined number of revolutions per minute irrespective of the throttle 64 when the steering handle 28 is turned to the left or to the right by more than a prescribed angle.

The fuel injection unit 61 includes a solenoid 62 for controlling the negative pressure based on information from the control unit (ECU) 101. The throttle 64 adjusts the amount of air-fuel mixture to be supplied to the engine 15 (See FIG. 1) by being mounted in an air intake path 63. A diaphragm 65 is provided for adjusting the opening of the throttle 64 by being provided between the solenoid 62 and the throttle 64. A throttle sensor 66 is provided for detecting the opening of the throttle. A one-way valve 67 is provided for preventing backflow of the negative pressure and entering of the positive pressure by being provided between the solenoid 62 and the air intake path 63. A surge tank 68 is provided for alleviating variations in negative pressure by being provided between the one-way valve 67 and the solenoid 62. An injector is provided 69 for supplying fuel into the air intake path 63 in mist form. In FIG. 4, the sign θ represents a throttle opening of the throttle 64.

Figure 5:
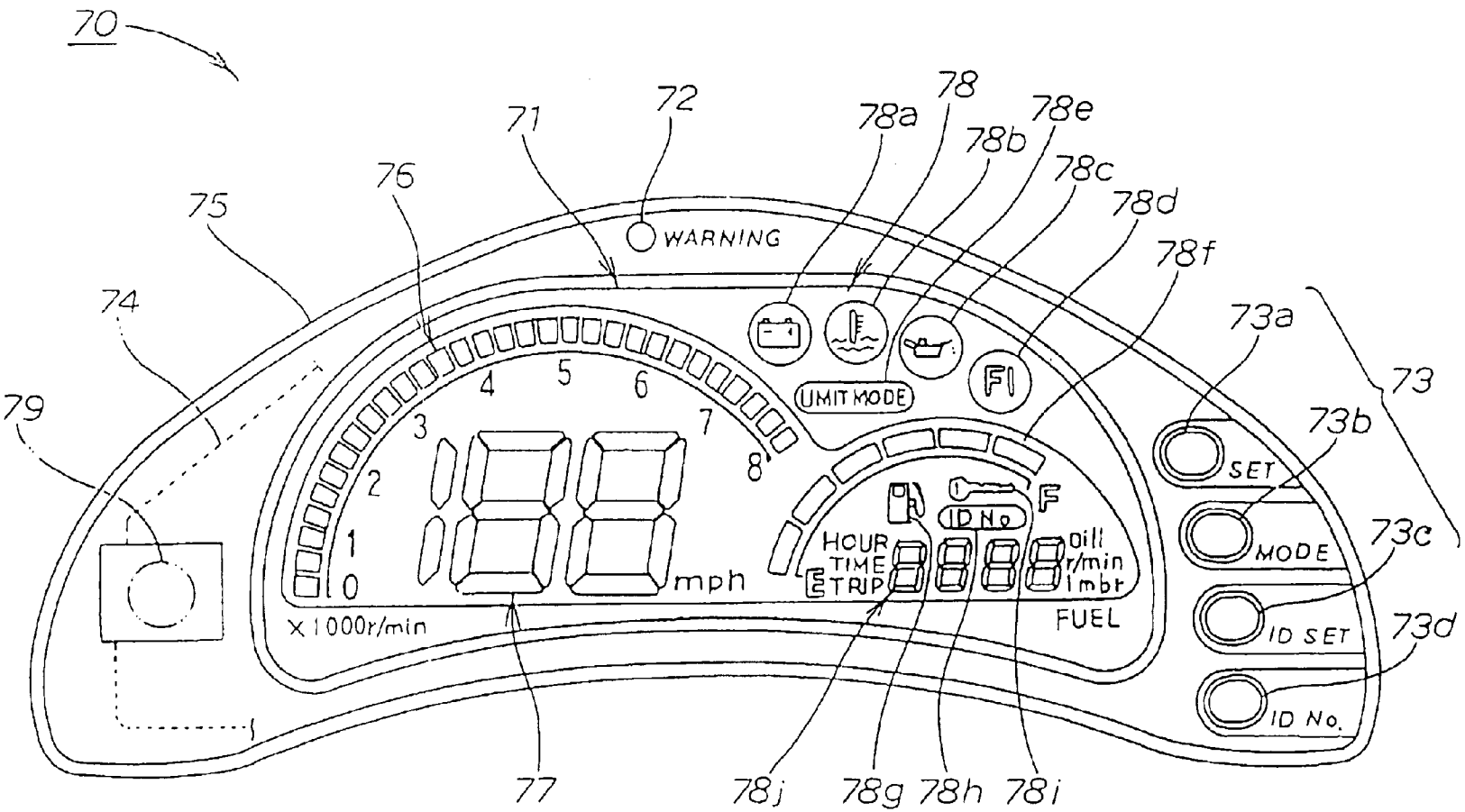
FIG. 5 is a drawing viewed in the direction shown by the arrow 5 in FIG. 1.

FIG. 5 is a drawing viewed in the direction shown by the arrow 5 in FIG. 1, showing a front of the display unit 70 of the jet propulsion boat (hereinafter abbreviated as "display unit 70").

The display unit 70 includes a liquid crystal device 71 as a liquid crystal display for displaying operational information. A warning lamp 72 is provided for being turned ON or flashed ON and OFF in various cases where warning is necessary. An operation switch 73 is provided for switching operation or input operation. A display control unit 74 is provided for driving the liquid crystal device 71 and the warning lamp 72 and controlling the hull 11. A housing 75 is provided for covering the liquid crystal device 71, the warning lamp 72, and the display control unit 74 together. A buzzer 729 is provided for generating a warning sound when the warning lamp 72 is turned on or flashed ON and OFF.

The liquid crystal device 71 includes a tachometer 76 for displaying the number of revolutions per minute of the engine 15 (See FIG. 1). A speed meter 77 is provided for displaying the speed of the boat, and a multifunction display 78 is provided for displaying information on the operation of various components or to provide various warnings.

The multifunction display 78 includes a charge mark 78*a* for being flashed ON and OFF when the voltage in the battery 27 (See FIG. 1) is lowered to a level below a prescribed value. A water temperature warning mark 78*b* is provided for being flashed ON and OFF when the temperature of cooling water increases to a level exceeding a prescribed temperature. An oil warning mark 78*c* is provided for being flashed ON and OFF when the quantity of engine oil is reduced to a level below a prescribed quantity or when the pressure of engine oil is lowered to a level below a prescribed value. A fuel injection unit warning mark 78*d* is provided for being flashed ON and OFF when an abnormality occurs in the fuel injection unit 61 (See FIG. 3) (hereinafter abbreviated to as "FI warning mark 78*d*). A limit mode display mark 78*e* is provided as a display lamp for displaying that the mode is set to a limited operation mode for limiting the output of the engine so as not to exceed a prescribed output. A residual quantity display meter 78*f* is provided for displaying the residual quantity of fuel. A fueling warning mark 78*g* is provided for alerting that it is time to refuel when the residual quantity of fuel is small. An ID number mark 78*h* is provided for being flashed ON and OFF when the ID (identification) number as a secret identification code for antitheft is set and locked. A key mark 78*i* is provided for being turned ON when the antitheft capability is released. A toggling display 78*j* is provided for toggling between a time display, a cruising time display, a display of the number of engine revolutions per minute (hereinafter abbreviated to as "Ne tacho display"), a cruising distance display, and an accumulated cruising hours display.

In other words, the jet propulsion boat 10 (See FIG. 1) is a propulsion boat which is provided with an antitheft capability capable of turning ON and OFF the power source by entering the ID number.

The operation switch 73 includes a set switch 73*a* to be used when setting the time of the day or the like. A mode switch 73*b* is provided for toggling the toggling display or setting the limited operation mode. An ID set switch 73*c* and an ID number switch 73*d* are used when typing the ID number.

Figure 6:
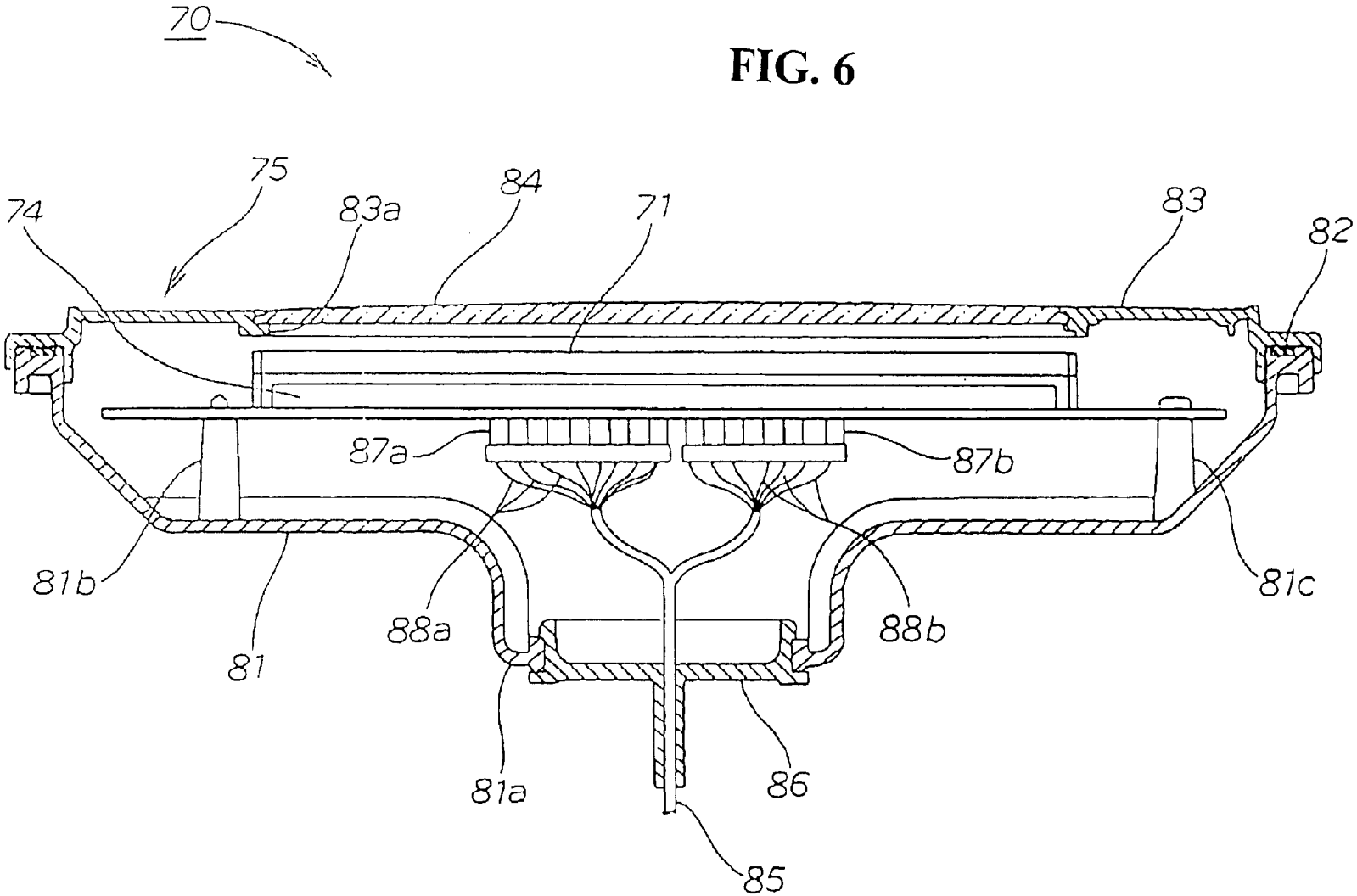
FIG. 6 is a plan view in cross section of the display unit for a jet propulsion boat according to the present invention.

FIG. 6 is a plan cross sectional view of the display unit in the jet propulsion boat according to the present invention, in which the housing 75 includes a lower case 81 for mounting the display control unit 74. An upper case 83 is mounted on the lower case 81 via a packing 82. A display window 84 is mounted on the opening 83*a* of the upper case 83. A bush 86 is provided for drawing a bundled harness 85 from the bottom 81*a* of the lower case 81.

The reference numeral and character 81*b* designates a boss for supporting the display control unit 74 by being set up on the lower case 81. The reference numeral and character 81*c* designates a securing boss for securing the display control unit 74 by being set up on the lower case 81. The reference numerals and characters 87*a* and 87*b* are connectors connected to the display control unit 74. The reference numerals and characters 88*a* and 88*b* are a plurality of harnesses extending from the display control unit 74.

Figure 7:
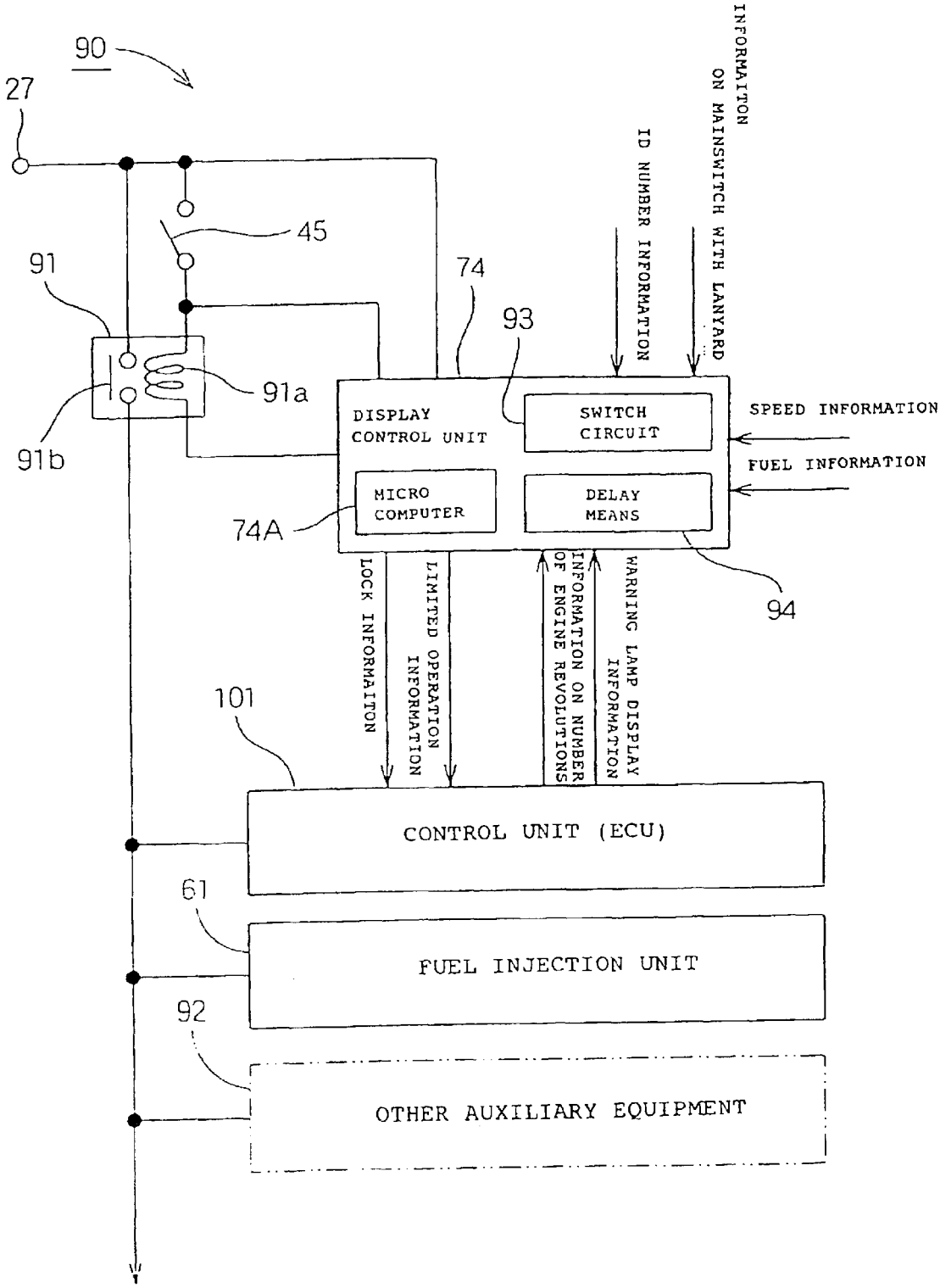
FIG. 7 is a block diagram of the power source system of a jet propulsion boat according to the present invention.

FIG. 7 is a block diagram of the power source system of a jet propulsion boat according to the present invention, in which the power source system 90 includes a main switch 45 with a lanyard switch connected in parallel to the battery 27. A main relay 91 is provided for turning the battery 27 ON and OFF to be supplied to the fuel injection unit 61 or to other auxiliary equipment 92 (fuel pump that will be described later) by connecting the coil portion 91*a* in series to the main switch 45 and connecting the switch portion 91*b* in series to the battery 27. The display control unit 74 is connected in parallel to the main switch 45 for controlling the main relay 91. The control unit (ECU) 101 is for controlling the engine 15 (See FIG. 1), which has a fuel injection unit 61 and the like.

The control unit (ECU) 101 is a part for controlling the jet propulsion boat 10 (See FIG. 1) that controls the engine 15. The control unit (ECU) controls the fuel injection unit 61 or other auxiliary equipment 92.

The display control unit 74 includes a microcomputer 74A as the backbone. A switch circuit 93 is provided for turning the power source of the display control unit 74 ON and OFF by entering information on the main switch 45 with the lanyard switch and a prescribed ID number. Delay means 94 is provided for delaying the action of the switch circuit 93 by a prescribed time period. The delay means 94 is provided for entering ID information such as antitheft information, information on the main switch with the lanyard switch, hull speed information, fuel information for displaying the residual quantity of fuel, information on the number of engine revolutions per minute, warning lamp display information for turning the multifunction display 78 or the warning lamp 72 shown in FIG. 5 ON, and so on. The delay means 94 is also provided for supplying limited operation information obtained when the fuel injection unit 61 (See FIG. 4) is controlled and operated under limitation or lock information notifying that the main relay 91 is in the OFF state. Reference numeral 92 designates other auxiliary equipment.

In other words, it is preferable that the power source system 90 is a power source system for a small boat including a main switch 45 with a lanyard switch that is capable of turning the power source off in case of an emergency by being connected to the occupant with a wire. A control unit is provided for supplying a power source to the auxiliary equipment, and the like including the fuel injection unit 61 and controlling the engine. A main relay 91 is provided for turning the power source to be supplied to the auxiliary equipment ON and OFF. A control unit (display control unit 74) is connected in parallel to the main switch 45 for controlling the main relay 91 and the ON/OFF state of the main switch 45 is monitored by the control unit (display control unit 74) and the main relay 91 is turned ON and OFF based on the ON/OFF state of the main switch 45.

The main relay 91 is provided for turning the power source to be supplied to auxiliary equipment including the fuel injection unit 61 ON and OFF, and the control unit (display control unit 74) to be connected in parallel to the main switch 45 is provided for controlling the main relay 91, so that the ON and OFF state of the main switch 45 is monitored by the control unit (display control unit 74) and the main relay 91 is turned ON and OFF based on the ON/OFF state described above. Accordingly, the ON/OFF of the power source to be supplied to the auxiliary equipment including the fuel injection unit 61 is totally controlled. As a consequence, simplification of the power source system 90 is realized.

The display control unit 74 outputs lock information notifying that the main relay 91 is in the OFF state to the control unit (ECU) 101. Therefore, the control unit (ECU) 101 holds lock information and thus the engine 15 (See FIG. 1) cannot be started even when the main relay 91 is connected directly.

In other words, the power source system 90 includes an antitheft capability in a control unit (display control unit 74), so that when the control unit (ECU) 101 is supplied information notifying that the main relay 91 is to be turned OFF from the control unit (display control unit 74), a stop signal for stopping the engine 15 based on this OFF information is supplied.

When information notifying that the main relay 91 is to be turned off is supplied from the control unit (display control unit 74), the engine 15 will never be started, for example, even when the main relay 91 is directly connected by supplying a stop signal for stopping the engine 15 based on this OFF information. Therefore, the small boat (jet propulsion boat 10) can be protected against theft.

Figure 8:
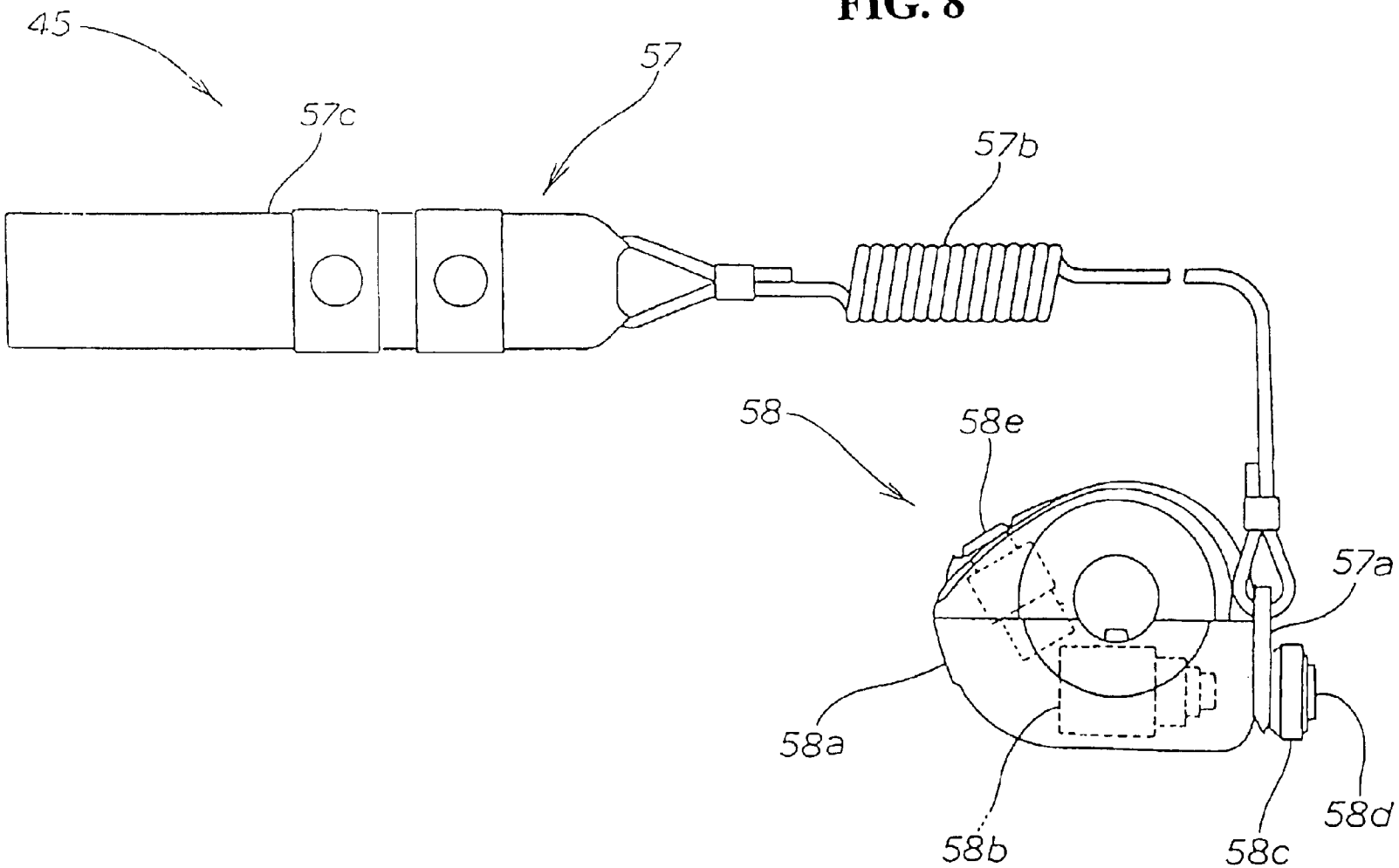
FIG. 8 is a side view of the main switch with a lanyard switch for a jet propulsion boat according to the present invention.

FIG. 8 is a side view of the main switch with a lanyard switch for a jet propulsion boat according to the present invention. The main switch 45 includes a lanyard switch unit (switch control strap) 57 for being connected to the occupant during travel and a main switch body 58 that can be operated to be switched ON and OFF by the lanyard switch.

The lanyard switch unit 57 includes a clip 57*a* for turning the power source ON and OFF by being clipped on or removed from the main switch body 58. An elasticized wire 57*b* extends from the clip 57*a*. A hand strap 57*c* is attached on the tip of the wire 57*b* for being attached on the arm of the occupant.

The main switch body 58 includes a housing 58*a* for being mounted on the hull 11 (See FIG. 1). A switch 58*b* is stored in the housing 58*a*. An outer knob 58*c* is provided for controlling the switch 58*b*. A stop button 58*d* is provided in the outer knob 58*c*. A start switch 58*e* is provided for starting the engine 15 (See FIG. 1).

The start switch 58*e* is adapted to turn the switch 58*b* ON when the outer knob 58*c* is pulled outward, maintain the ON state when the clip 57*a* of the lanyard switch unit 57 is clipped, restore the switch 58*b* to the initial OFF position automatically when the clip 57*d* is removed, and turn the power source OFF by pressing the stop button 58*d* with the clip 57*a* clipped. The operation of the main switch 45 with the lanyard switch will be described in detail below.

Figure 9A:
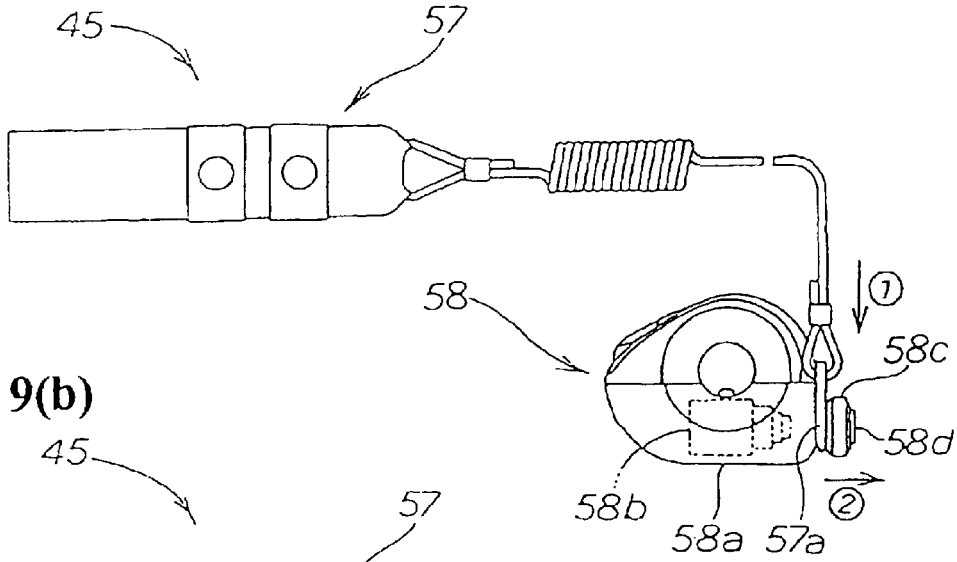
FIGS. 9(*a*) to 9(*c*) are drawings showing the operation of the main switch with lanyard switch for a jet propulsion boat according to the present invention.
Figure 9B:
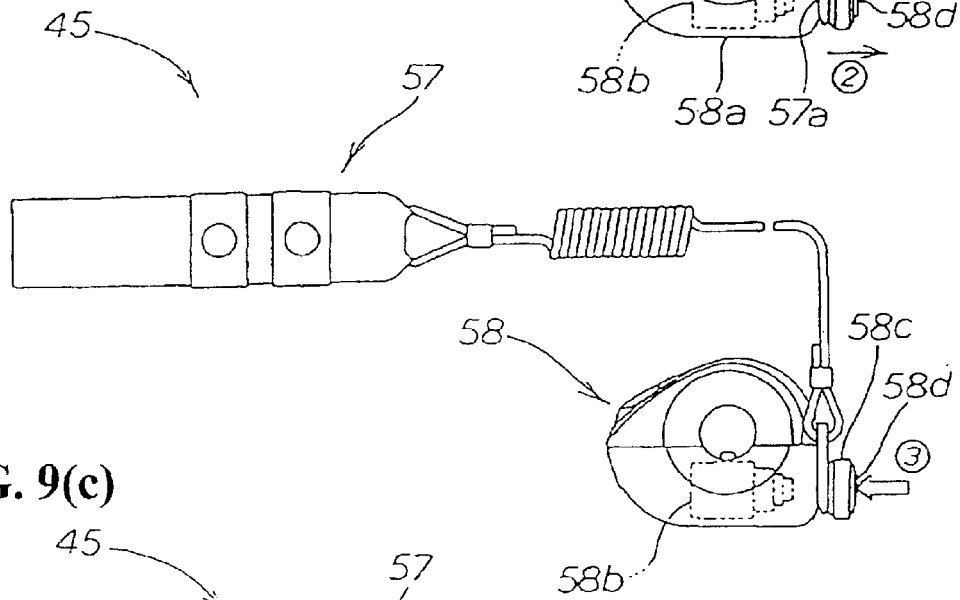
Figure 9C:
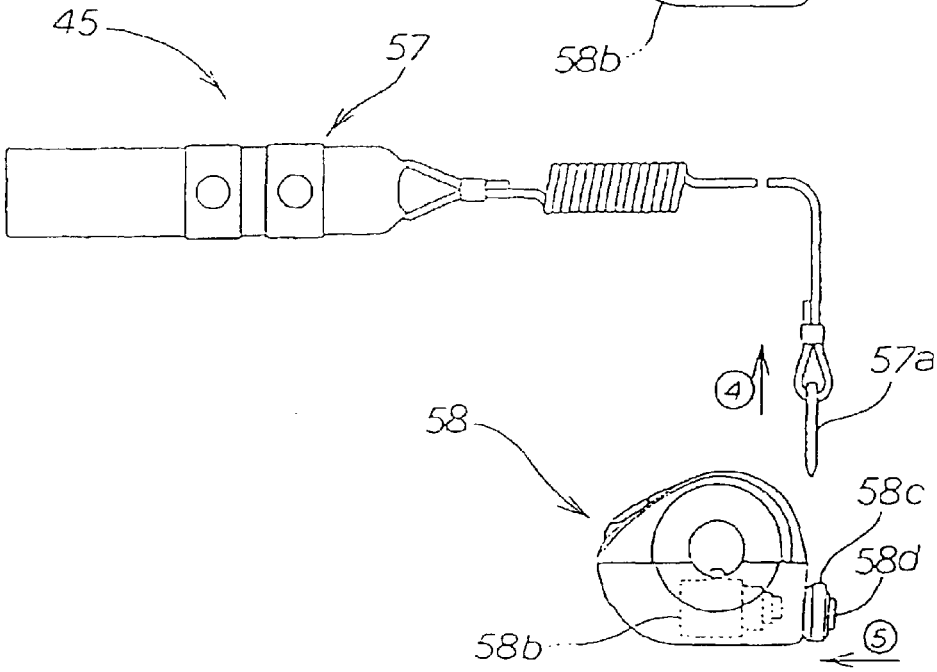

FIGS. 9(*a*) to 9(*c*) are drawings showing the operation of the main switch with the lanyard switch for a jet propulsion boat according to the present invention.

In FIG. 9(*a*), when the clip 57*a* of the lanyard switch unit 57 is pushed into a position between the housing 58*a* of the main switch body 58 and the outer knob 58*c* as shown by the arrow ←, the outer knob 58*c* is moved as shown by the arrow ↑. Accordingly, the switch 58*b* is turned ON.

In FIG. 9(*b*), when the stop button 58*d* is pressed as shown by the arrow → with the lanyard switch unit 57 fitted to the main switch body 58, the switch 58*b* can be turned OFF.

In FIG. 9(*c*), when the clip 57*a* of the lanyard switch unit 57 between the housing 58*a* and the outer knob 58*c* of the main switch body 58 is pulled out as shown by the arrow ↓, the outer knob 58*c* returns automatically as shown by the arrow ° with the stop button 58*d* and the main switch body 58 turned OFF.

The procedure for controlling the jet propulsion boat 10 will now be described below.

Figure 10:
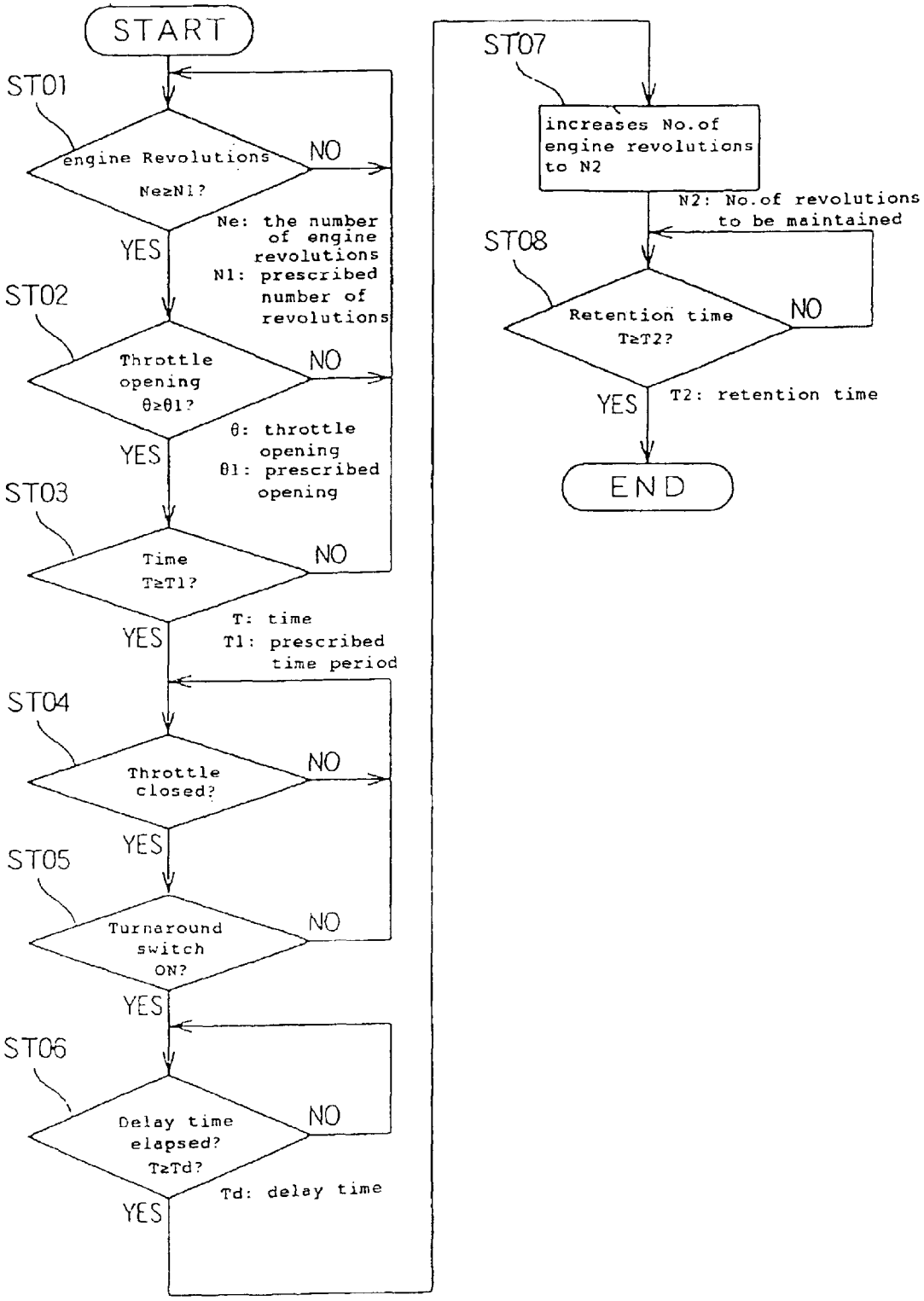
FIG. 10 is a flow chart for controlling the jet propulsion boat according to the present invention.

FIG. 10 is a flow chart for controlling the jet propulsion boat according to the present invention. In this chart, STxx represents the step number (as regards reference numerals, see FIG. 4).

ST01: When Ne represents the number of engine revolutions per minute, and N1 is a prescribed number of engine revolutions per minute (hereinafter referred to as "prescribed number of revolutions per minute N1"), it is determined whether or not the number of engine revolutions per minute Ne exceeds a prescribed number of revolutions per minute N1 (Ne≧N1). If YES, the procedure proceeds to ST02, and if NO, returns to START. In this case, a prescribed number of revolutions per minute N1 is set to 3700 rpm.

ST02: When θ represents the throttle opening, and θ1 represents a prescribed throttle opening (hereinafter referred to as a "prescribed opening θ1"), it is determined whether or not the throttle opening θ exceeds a prescribed opening θ1. If YES, the procedure proceeds to ST03, and if NO, returns to ST01. In this case, a prescribed opening θ1 is set to 13°.

ST03: When T represents the time period, and T1 represents a prescribed time period, it is determined whether or not a state in which the number of revolutions per minute and the opening exceed a prescribed number of revolutions per minute N1 and a prescribed opening θ1, respectively has been continuing for more than a prescribed time period T1. If YES, the procedure proceeds to ST04, and if NO, returns to ST01. In this case, a prescribed time period T1 is set to 2 seconds.

ST04: It is determined whether or not the throttle 64 was closed (throttle opening θ=0). If YES, the procedure proceeds to ST05, and if NO, repeats ST04.

ST05: It is determined whether or not the turnaround switch 53 is turned ON. If YES, the procedure proceeds to ST06, and if NO, returns to ST04.

ST06: When Td represents a prescribed delay time, it is determined whether or not the delay time Td has elapsed (T≧Td). In this case, the delay time Td is set to 0.7 seconds. If YES, the procedure proceeds to ST07, and if NO, repeats ST06.

ST07: When N2 represents a prescribed number of revolutions per minute to be maintained, the number of engine revolutions per minute Ne is increased to the number of revolutions per minute to be maintained N2 and is maintained constant. In this case, the number of revolutions per minute to be maintained N2 is set to 2100 rpm.

ST08: When T2 represents a prescribed retention time, it is determined whether or not the retention time T2 has elapsed. If YES, the procedure terminates, and if NO, repeats ST08. In this case, the retention time T2 is set to 7 seconds.

In the above described controlling procedure, when the engine 15 (See FIG. 1) rotates for more than a prescribed time period T1 at more than a prescribed number of revolutions per minute N1 and the throttle 64 (See FIG. 4) has been opened for more than a prescribed time period T1 by more than a prescribed opening θ1 a stand-by state condition occurs. Even when the state of the hull 11 (See FIG. 1) is not in the stand-by state condition, it is controlled so that the stand-by state is maintained until a prescribed time period (for example, 5 seconds) elapses.

The retention time of the stand-by state can be controlled by changing the number of revolutions per minute Ne of the engine 15 in the stand-by state and the opening θ of the throttle 64. Accordingly, the OTS (Off Throttle Steering System) of the hull 11 can be controlled.

In other words, a jet propulsion boat 10 (See FIG. 1) is of the type in which the hull 11 is advanced by generating a jet water stream by a jet propulsion unit 17 driven by an engine 15 and discharging the jet water stream through the steering pipe 25 (nozzle), and the hull 11 is turned around to the left and the right by changing the direction of the nozzle by the steering handle 28. The jet propulsion boat 10 includes a control unit 101 (See FIG. 4) for controlling the number of engine revolutions per minute to a predetermined number of revolutions per minute when the throttle 64 is closed and when the engine 15 has been rotated for more than a prescribed time period T1 at more than a prescribed number of revolutions per minute N1, and a throttle 64 (See FIG. 4) has been opened for more than a prescribed time period T1at more than a prescribed opening θ1. The control unit 101 increases the number of engine revolutions per minute to a predetermined number of revolutions per minute (the number of revolutions per minute to be maintained N2) irrespective of the throttle 64 and maintains the same number of revolutions per minute for a predetermined retention time T2 when the steering handle 28 is turned to the left or the right by more than a prescribed angle. In addition, the delay time Td for delaying the time to start controlling of the number of engine revolutions per minute is provided in the control unit.

When the throttle is closed and the steering handle 28 (See FIG. 4) is turned in order to evade an obstacle which has appeared in front of the hull 11 (See FIG. 1), the quantity of the jet water stream is reduced and thus the turnability is lowered. Therefore, the number of engine revolutions per minute is increased under constant conditions to the predetermined number of revolutions per minute to increase the quantity of the jet water stream.

When the throttle 64 is closed and the number of engine revolutions per minute is lowered to travel at a low speed, for example, for entering into a port, it is not necessary to increase the number of engine revolutions per minute Ne. Since the turnability is put in question in this case, it is not necessary to increase the number of engine revolutions per minute when the steering handle 28 is not turned.

Therefore, the precondition is determined to be such that when the throttle 64 is closed under the conditions that the engine 15 (See FIG. 1) has been rotated for more than a prescribed time period T1 at more than a prescribed number of revolutions per minute N1 and the throttle 64 (See FIG. 4) has been opened for more than a prescribed time period T1at more than a prescribed opening θ1, and that the steering handle 28 is turned to the left or to the right by more than a prescribed angle.

Accordingly, the number of engine revolutions per minute Ne is increased to a predetermined number of revolutions per minute (the number of revolution to be maintained N2) only when necessary.

It is well known that the amount of sideslip of the hull 11 (See FIG. 1) is large when the steering handle 28 (See FIG.

4) is turned while cruising at a high speed, while the amount of sideslip of the hull is small when the steering handle 28 is turned while cruising at a low speed. Therefore, the time to start controlling of the number of engine revolutions per minute is delayed by providing a delay time Td for delaying the time to start controlling of the engine revolutions, and the amount of sideslip of the jet propulsion boat 10 (See FIG. 1) is reduced by controlling the number of engine revolutions per minute after the hull 11 is underwater.

In addition, the quantity of the jet water stream is secured by providing a control unit 101 (See FIG. 4) for increasing the number of engine revolutions per minute Ne to a predetermined number of revolutions per minute (the number of revolutions per minute to be maintained N2) and maintaining the same number of revolutions per minute for a predetermined retention time T2. Consequently, the steering of a jet propulsion boat 10 (See FIG. 1) is improved.

Figure 11:
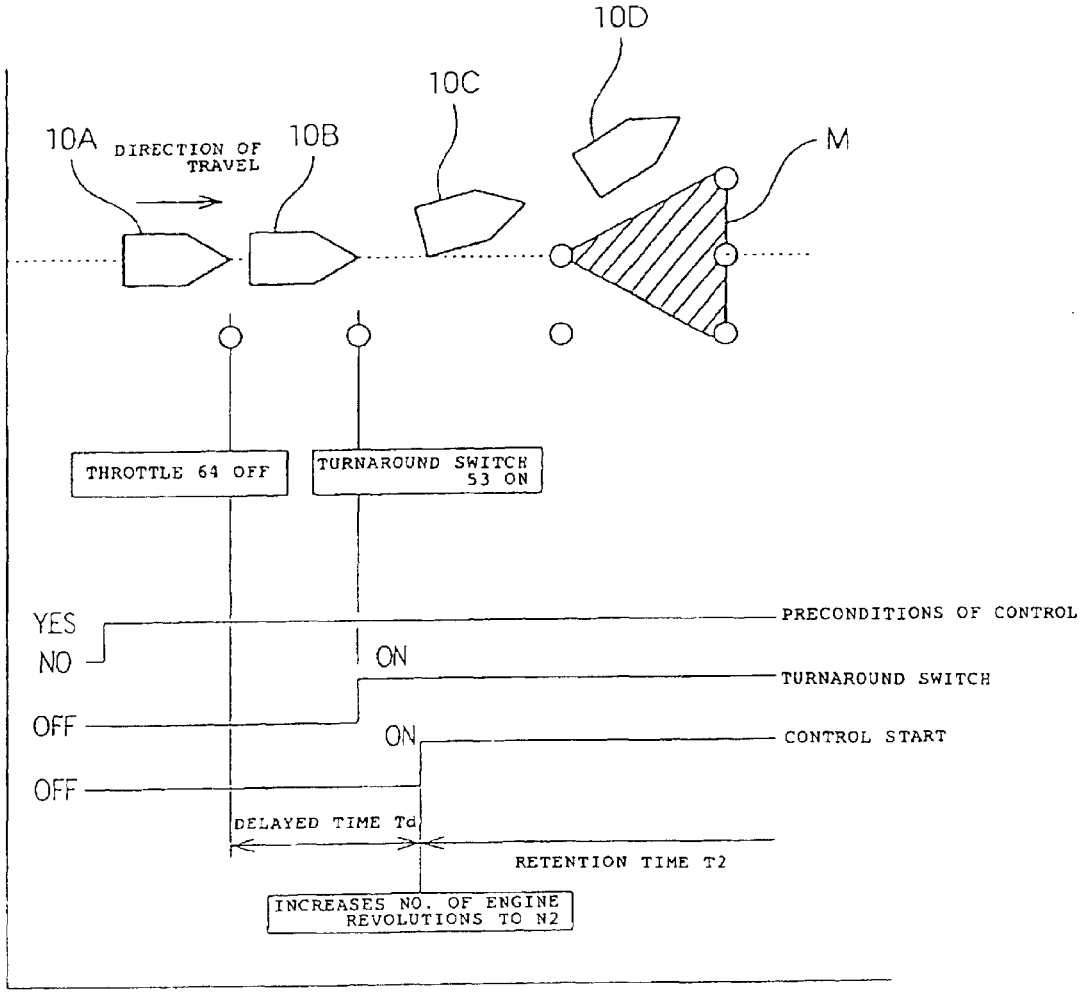
FIG. 11 is an explanatory drawing illustrating the operation of the jet propulsion boat according to the present invention.

FIG. 11 is an explanatory drawing illustrating the operation of the jet propulsion boat according to the present invention. The figures of the jet propulsion boat 10 as it moves over time is shown by designating the reference numerals and signs 10A–10D.

The jet propulsion boat 10A is cruising on the precondition for control that a prescribed number of revolutions per minute N1 and a prescribed opening θ1 are exceeded, that a prescribed time period T1 is exceeded as shown in FIG. 10. Then, the navigator finds an evasion buoy M and thus he or she faces the necessity of evading the evading buoy M.

In the jet propulsion boat 10B, the throttle 64 is closed and the steering handle 28 (See FIG. 4) is operated to turn around in order to evade the evading buoy M. However, the jet propulsion boat 10B cannot turn around without a jet water stream as described above. Therefore, the number of engine revolutions per minute Ne is increased to N2 to generate a jet water stream (controlled start) after a prescribed delay time Td under the conditions that the throttle 64 is turned OFF and the turnaround switch 53 is turned ON. The sequence of turning the throttle 64 OFF and of turning the turnaround switch 53 ON may be either way.

Since the jet propulsion boat cruises in the gliding state at the point designated by 10B, it often slips sideways. Therefore, performing a controlled start after a prescribed delay time is preferable for turning the hull 11 (See FIG. 1) around effectively.

The jet propulsion boat starts a turnaround at the point designated by 10C. As a consequence, the jet propulsion boat can evade the evading buoy M at the point 10D at the navigator's will.

Figures 12A, 12B, 12C, 12D, 12E:
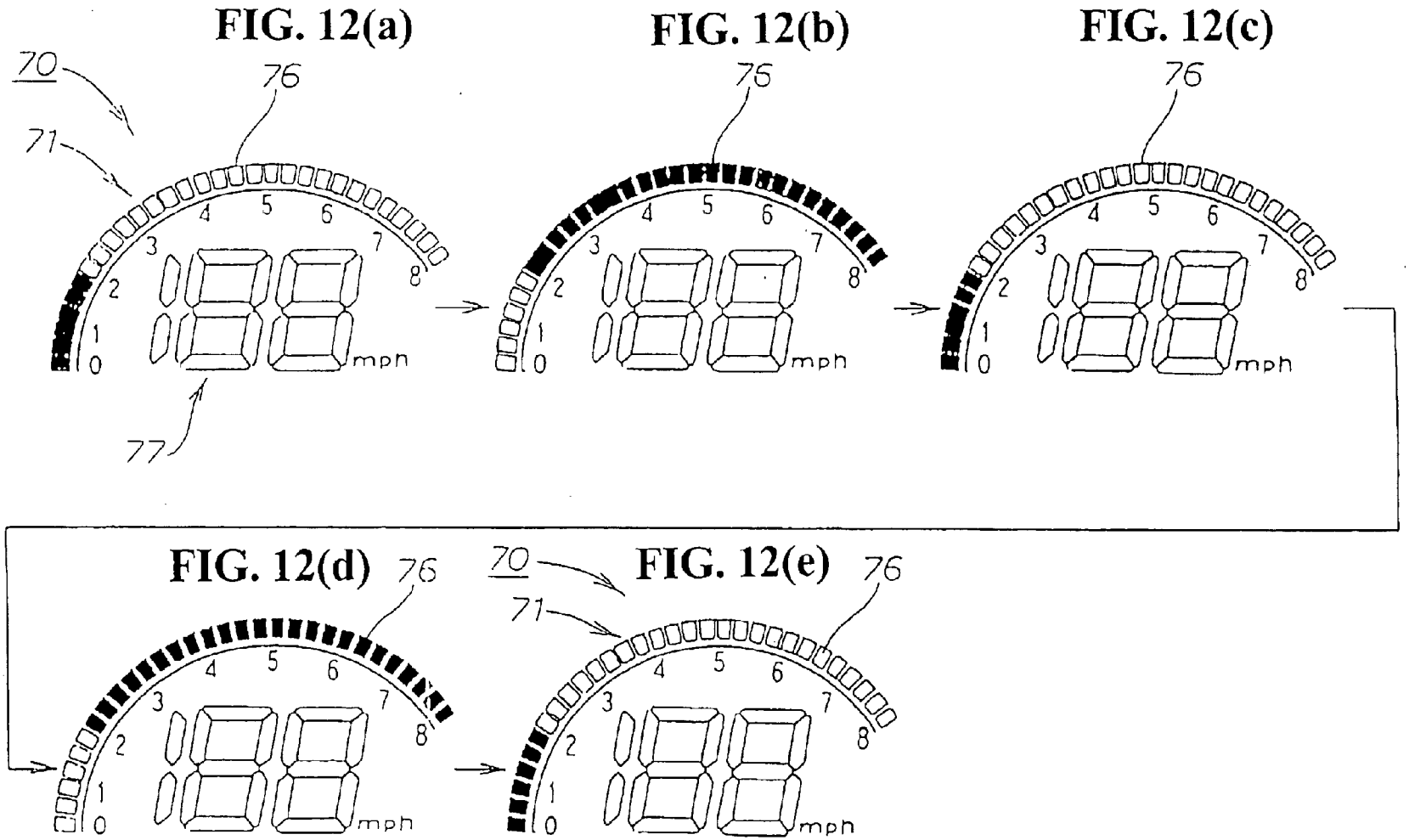
FIGS. 12(*a*) to 12(*e*) are explanatory drawings illustrating the display pattern of the display unit during control of increasing the number of engine revolutions per minute in association with the steering operation of the jet propulsion boat according to the present invention.

FIGS. 12 (*a*)–(*e*) are explanatory drawings illustrating the display pattern of the display unit during the control of increasing the number of engine revolutions per minute in association with the steering operation of the jet propulsion boat according to the present invention.

FIG. 12(*a*) shows a display pattern of the tachometer 76 in the display unit 70 during cruising (hereinafter referred to as "normal state"), showing that when the number of engine revolutions per minute Ne is increased to 2000 rpm, the range from 0 to 2 is displayed in black, and the range from 2 to 8 is displayed in white.

FIGS. 12(*b*)–(*e*) show display patterns of the tachometer 76 under control (hereinafter referred to as "abnormal state"), showing that the tachometer 76 on the liquid crystal display (liquid crystal device 71) flashes.

More specifically, when the state of the jet propulsion boat is changed from the normal state to the abnormal state, the black-and-white display of the liquid crystal display (liquid crystal device 71) is inverted. The portion displayed in white under the normal state is invertedly flashed in order of black, white, black under the abnormal state, and the portion displayed in black under the normal state is invertedly flashed in order of white, black, white under the abnormal state.

In other words, in the transportation means (jet propulsion boat 10) provided with the liquid crystal display (liquid crystal device 71) for displaying operational information, when the normal operation of the transportation means is considered as a normal state and a state in which the speed of the transportation means has to be reduced suddenly or the direction of the transportation means has to be changed suddenly is considered as an abnormal state, the liquid crystal display (liquid crystal device 71) is adapted to invert the black-and-white display of the liquid crystal display when the transportation means is changed from the normal state to the abnormal state.

When the transportation means (the jet propulsion boat 10) is changed from the normal state to the abnormal state, the fact that the transportation means is in the abnormal state is notified to the navigator sensuously and directly by inverting the black-and-white display of the liquid crystal display (liquid crystal device 71). As a consequence, the fact that the hull 11 is in the abnormal state can easily be recognized.

It is also preferable that the portion displayed in white in the normal state is invertedly flashed in order of black, white, black in the abnormal state, and the portion displayed in black in the normal state is invertedly flashed in order of white, black, white in the abnormal state.

In other words, in the abnormal state, the fact that the transportation means (jet propulsion boat 10) is in the abnormal state is strongly impressed on the navigator by invertedly flashing the display in the abnormal state.

Figure 13:
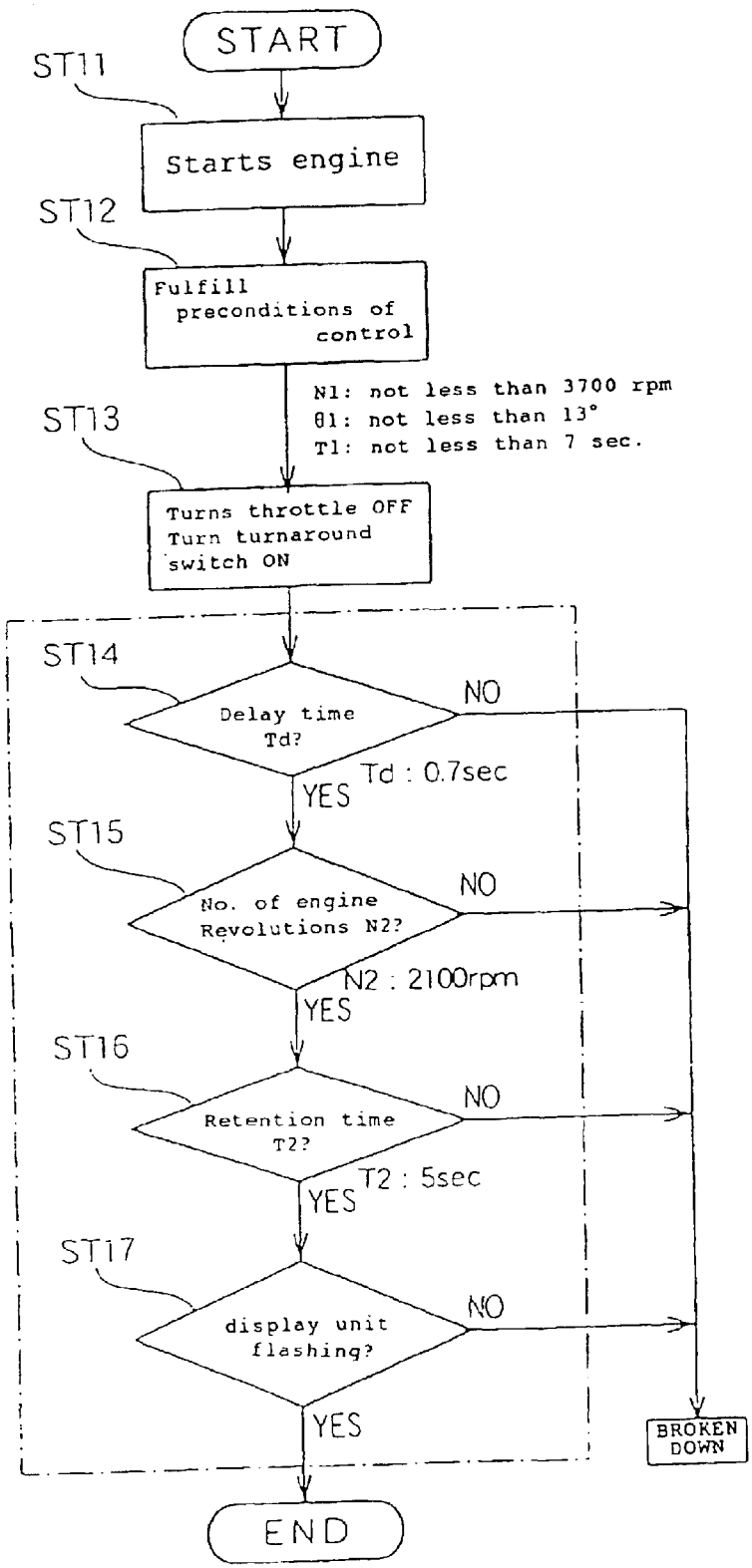
FIG. 13 is an explanatory chart showing the procedure of the everyday check-up of the jet propulsion boat according to the present invention.

FIG. 13 is an explanatory chart showing the procedure of the everyday check-up of the jet propulsion boat according to the present invention. In this chart, STxx represents the step number (as regards reference numerals, see FIG. 4).

ST11: The engine 15 (See FIG. 1) is started.

ST12: The preconditions of control are satisfied. In other words, a prescribed number of revolutions per minute N1 of at least 3700 rpm, a prescribed opening θ1 of at least 13°, and a prescribed time period T1 of at least 2 seconds are maintained.

ST13: The throttle 64 is turned OFF, and the turnaround switch 53 is turned ON.

ST14: It is determined whether or not the delay time Td is normal (The normal value is Td=0.7 seconds). If YES, the procedure proceeds to ST15, and if NO, the control unit 101 may be broken.

ST15: It is determined whether or not the number of engine revolutions per minute Ne is increased to N1=2100 rpm. If YES, the procedure proceeds to ST16. If NO, the solenoid 62, the air intake path 63, or a throttle link 47 (See FIG. 3) may be broken.

ST16: It is determined whether or not the retention time T2 is normal (the normal value is Td=7 seconds). If YES, the procedure proceeds to ST17, and if NO, the control unit 101 may be broken.

ST17: If NO, it is determined whether or not the display unit 70 invertedly flashes. If YES, the everyday check-up is terminated. If NO, the display unit 70, the turnaround switch 53, or the throttle sensor 66 may be broken.

Figure 14:
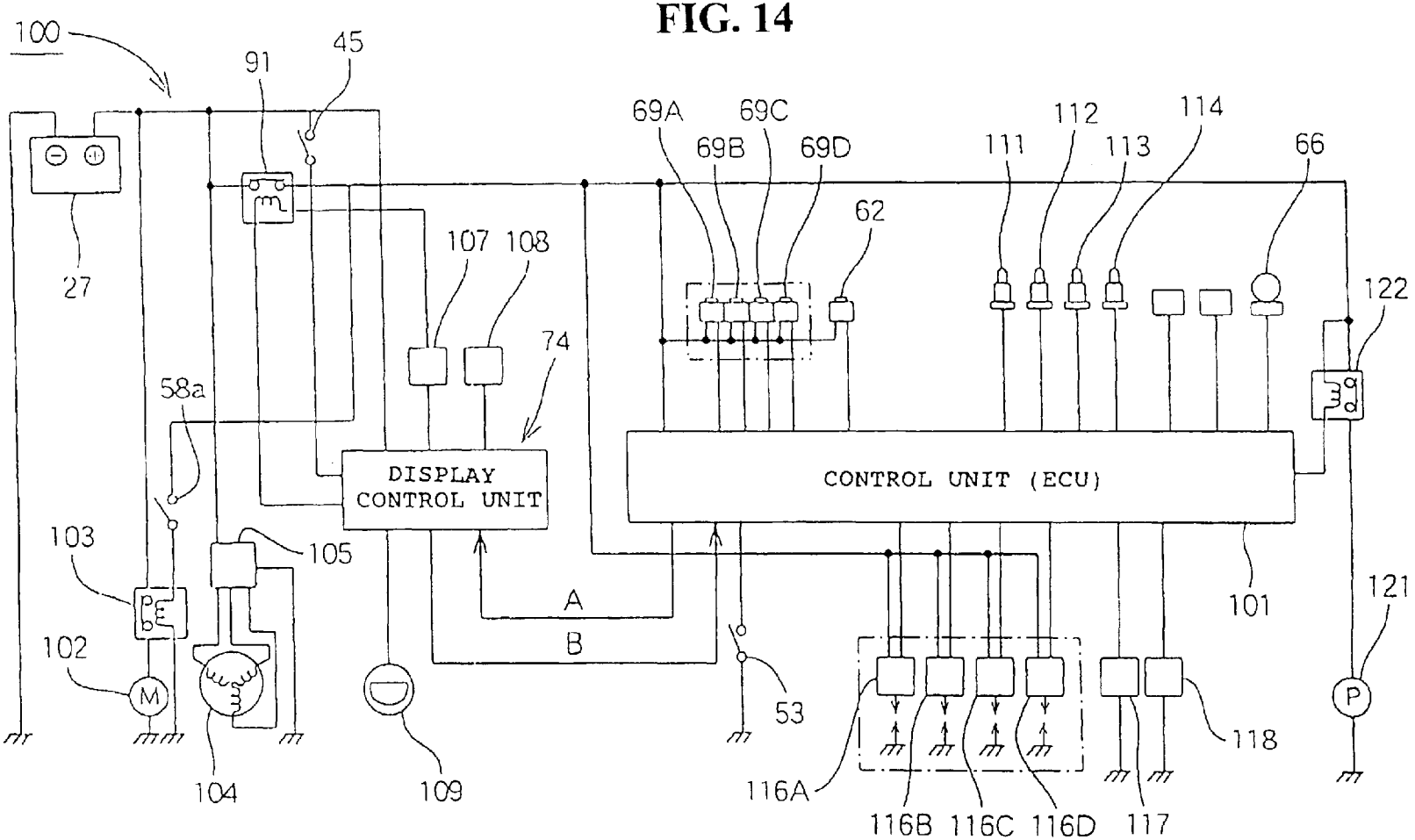
FIG. 14 is a drawing showing a control system for a jet propulsion boat according to the present invention.

FIG. 14 is a drawing showing a control system for a jet propulsion boat according to the present invention.

The control system 100 for a jet propulsion boat is a system mainly including a battery 27 as a power source, injectors 69 (referred to as "injectors 69A–69D" here) of the fuel injection unit 61 (See FIG. 4), the main relay 91, the display control unit 74 mounted on the display unit 70 (See FIG. 5), and a control unit (ECU) 101 for controlling the engine 15 (See FIG. 1).

FIG. 14, the reference numeral 102 designates a starter, the numeral 103 designates a starter relay for turning the starter 102 ON/OFF, the numeral 104 designates a power generating machine, the numeral 105 designates a regulator for adjusting the voltage generated by the power generating machine, the numeral 107 designates a buzzer connected to the display control unit 74, the numeral 108 designates a speed sensor connected to the display control unit 74, the numeral 109 designates a fuel sensor connected to the display control unit 74, the numeral 111 designates a temperature sensor connected to the control unit (ECU) 101, the numeral 112 designates a water temperature sensor connected to the control unit (ECU) 101, the numeral 113 designates a exhaust temperature detecting sensor connected to the control unit (ECU) 101, the numeral 114 designates an oil temperature sensor for detecting the temperature of engine oil by being connected to the control unit (ECU) 101, the numerals and signs 116A–116D designate ignition system members (ignition plug and ignition coil), the numeral 117 designates an oil pressure sensor, the numeral 118 is a knock sensor for detecting knocking of the engine 15, the numeral 121 designates a fuel pump, and the numeral 122 designates a relay for turning the fuel pump ON/OFF.

The flow shown by the arrow A represents engine oil information, temperature information, fuel information, information on the number of engine revolutions per minute, warning lamp display information, and OTS (Off Throttle Steering System) information to be supplied from the control unit (ECU) 101 to the display control unit 74.

The flow shown by the arrow B represents lock information and limited operation information to be supplied from the display control unit 74 to the control unit (ECU) 101.

As shown in FIG. 10, although control is made with a constant retention time T2 in the embodiment, it is not limited thereto. Since the amount of sideslip of the hull is large when the steering handle is turned while cruising at a high speed, and the amount of sideslip of the hull is small when the steering is turned while cruising at a low speed, it may be constructed in such a manner that control is made while the retention time or the number of revolutions per minute to be retained is dependent on the vessel speed when being controlled. As a consequence, steering of the jet propulsion boat can further be improved.

As shown in FIG. 10, although control is made with a constant retention time T2 in the embodiment, it is not limited thereto, and may be controlled in such a manner that the retention time T2 may be varied according to the number of engine revolutions per minute and the opening of the throttle that satisfy the preconditions of control. As a consequence, steering of the jet propulsion boat can further be improved. Furthermore, although control is made with a constant number of revolutions per minute to be maintained N2, it is not limited thereto, and may be controlled so that the number of revolutions per minute to be maintained is adjusted by the number of engine revolutions per minute and the opening of the throttle that satisfy the preconditions of control.

The present invention constructed as described above exercises the following effects.

It is well known that the amount of sideslip of the hull is large when the steering handle is turned while cruising at high speed, while the amount of sideslip of the hull is low when the steering handle is turned while cruising at a low speed.

According to the first aspect of the present invention, since the delay time for delaying the time to start controlling of the number of engine revolutions per minute is provided, the time to start controlling of the number of engine revolutions per minute is delayed and thus control of the number of engine revolutions per minute may be performed after the hull is underwater. As a consequence, the amount of sideslip of the jet propulsion boat may be reduced.

According to the second aspect of the present invention, a control unit is provided for controlling the number of engine revolutions per minute to a predetermined number of revolutions per minute when the throttle is closed and when the engine has been rotated for more than a prescribed time period at more than a prescribed number of revolutions per minute, and a throttle has been opened for more than a prescribed time period at more than a prescribed opening. The control unit increases the number of engine revolutions per minute to a predetermined number of revolutions per minute irrespective of the throttle and maintains the same number of revolution for a predetermined retention time when the steering handle is turned to the left or the right by more than a prescribed angle. Accordingly, the quantity of a jet water stream can be secured. As a consequence, steering of the jet propulsion boat is improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A jet propulsion boat, comprising:

a hull, said hull being advanced by generating a jet water stream by a jet propulsion unit driven by an engine and discharging the jet water stream through a nozzle, said hull being turnable to the left and the right by changing a direction of the nozzle by a steering handle; and a control unit, said control unit controlling a number of engine revolutions per minute when a throttle of the engine is closed and when said control unit determines that the engine has been rotating at more than a prescribed number of revolutions per minute and the throttle has been open at more than a prescribed opening for a prescribed time period, wherein a delay time for delaying a time for starting the controlling of the number of engine revolutions per minute is provided by the control unit.

2. The jet propulsion boat according to claim 1, wherein said control unit increases the number of engine revolutions per minute to a predetermined number of revolutions per minute irrespective of the throttle and maintains the same number of revolutions per minute for a predetermined retention time when the steering handle is turned to the left or the right by more than a prescribed angle.

3. A control system of a jet propulsion boat, comprising:

a control unit, said control unit controlling a number of engine revolutions per minute when a throttle of the boat engine is closed and when said control unit determines that the engine has been rotating at more than a prescribed number of revolutions per minute and the throttle has been open at more than a prescribed opening for a prescribed time period, wherein a delay time for delaying a time for starting the controlling of the number of engine revolutions per minute is provided by the control unit.

4. The control system of a jet propulsion boat according to claim 3, wherein said control unit increases the number of engine revolutions per minute to a predetermined number of revolutions per minute irrespective of the throttle and maintains the same number of revolutions per minute for a predetermined retention time when a steering handle of the jet propulsion boat is turned to the left or the right by more than a prescribed angle.

5. A jet propulsion boat, comprising:

a hull, said hull being advanced by generating a jet water stream by a jet propulsion unit driven by an engine and discharging the jet water stream through a nozzle, said hull being turnable to the left and the right by changing a direction of the nozzle by a steering handle; and a control unit, said control increasing a number of engine revolutions per minute when a throttle of the engine is closed and when said control unit determines that the engine has been rotating for more than a prescribed time period at more than a prescribed number of revolutions per minute, and the throttle has been opened for more than a prescribed time period at more than a prescribed opening.

6. The jet propulsion boat according to claim 5, wherein said control unit increases the number of engine revolutions per minute to a predetermined number of revolutions per minute irrespective of the throttle and maintains the same number of revolutions per minute for a predetermined time period when the steering handle is turned to the left or the right by more than a prescribed angle.

7. A control system of a jet propulsion boat, comprising:

a control unit, said control unit increasing the number of engine revolutions per minute to a predetermined number of revolutions per minute when a throttle of the boat engine is closed and when said control unit determines that the engine has been rotating for more than a prescribed time period at more than a prescribed number of revolutions per minute, and the throttle has been opened for more than a prescribed time period at more than a prescribed opening.

8. The control system of a jet propulsion boat according to claim 7, wherein said control unit increases the number of engine revolutions per minute to a predetermined number of revolutions per minute irrespective of the throttle and maintains the same number of revolutions per minute for a predetermined time period when a steering handle of the jet propulsion boat is turned to the left or the right by more than a prescribed angle.

* * * * *